US005905425A

United States Patent [19]

Dalby et al.

[11] Patent Number: 5,905,425

[45] Date of Patent: May 18, 1999

[54] COW MAGNET

[76] Inventors: Larry S. Dalby, 730 N. Muleshoe Rd., Apache Junction, Ariz. 85219; Thomas D. Rigley, 9714 Briarwood Cir. North, Sun City, Ariz. 85351

[21] Appl. No.: 09/120,767

[22] Filed: Jul. 22, 1998

[51] Int. Cl.[6] ..... H01F 7/02

[52] U.S. Cl. ..... 335/302; 335/306

[58] Field of Search ..... 335/302–306

[56] References Cited

U.S. PATENT DOCUMENTS

| | | | |
|---|---|---|---|
| 2,613,246 | 10/1952 | Spodig . | |
| 2,853,075 | 9/1958 | Hoffman et al. | 335/306 |
| 3,005,458 | 10/1961 | Brook et al. . | |
| 3,014,751 | 12/1961 | Smith . | |
| 3,187,239 | 6/1965 | Rosenberger et al. . | |
| 3,206,657 | 9/1965 | Moriya . | |
| 4,283,698 | 8/1981 | Fujisawa . | |
| 4,303,062 | 12/1981 | Vars . | |
| 4,544,904 | 10/1985 | Tarachand . | |
| 4,749,978 | 6/1988 | Imamura et al. . | |
| 4,888,068 | 12/1989 | Tokunaga et al. . | |
| 4,992,768 | 2/1991 | Mozis et al. . | |
| 5,096,763 | 3/1992 | Ogata et al. . | |
| 5,128,644 | 7/1992 | Nellessen . | |
| 5,663,701 | 9/1997 | Kaura . | |

*Primary Examiner*—Lincoln Donovan
*Attorney, Agent, or Firm*—Schmeiser, Olsen & Watts

[57] ABSTRACT

A cow magnet is provided having two magnets and a metal plate inside of a nontoxic cover. The non-toxic cover is preferably a plastic cover having a hollow interior, a cylindrical exterior, and two rounded ends. The two magnets a preferably constructed of ceramic materials. The metal plate is positioned between the two magnets to concentrate the magnetic field produced by the two magnets.

11 Claims, 5 Drawing Sheets

COW MAGNET

BACKGROUND OF THE INVENTION

1. Technical Field

This invention generally relates to bovine health, and more specifically relates to the prevention of hardware disease in cattle.

2. Background Art

Cows feed by rapidly swallowing food, such as grass or hay, and later regurgitating the food and chewing it more thoroughly, a process known as "chewing cud". This process of rapidly swallowing food and leaving the chewing to later probably served cows well in years long past, when the need to rapidly consume grass before a predator happened by was more acute. The initial, highly vulnerable feeding could be quickly concluded, while the more time consuming chewing could be done in a position of relative safety with the head up and alert.

Unfortunately, that which was once an asset to bovines has become a liability. In today's typical farm or ranch environment, predators may exist, but they no longer pose a grave threat to most cattle. On the other hand, the typical bovine feeding process now presents health risks to the cattle themselves. Because the initial feeding is done rapidly, a cow will often ingest materials other than its intended food. If the material ingested is metal, the cow's health may be in jeopardy due to internal injuries the metal might inflict. Ideally, no metal objects would be available for ingestion, but the reality is that even the most stringent efforts to prevent metal from entering cattle foodstuffs (such as hay, silage, and grain) or cattle pastures cannot entirely prevent the ingestion of metal fragments by cattle.

Because a cow will inevitably ingest metal objects, steps should be taken to preserve a cow's health from the results of metal ingestion, which is known as "hardware disease". Hardware disease refers to the variety of detrimental effects that can occur to a cow that has ingested metal. While metal scraps in a cow's stomach can cause harm, the greatest harm tends to occur when the metal scraps pass from the cow's first stomach and into later stomachs and its intestines. Because it is generally impractical to remove metal scraps from a cow's stomach, the focus of hardware disease prevention has been to retain pieces of metal in a cow's first stomach, rather than allowing them to pass on to the cow's later stomachs and intestines where the greatest harm can occur.

To this end, a variety of "cow magnets" have been developed. In general, a cow magnet is a magnet placed in a cow's stomach so that metal fragments will attach to it and be prevented from passing on to the cow's intestines. In constructing such a device, several factors must be considered. First, the magnet must create a magnetic field sufficiently strong to attract and capture substantially all of the metal scraps found in a cow's stomach. Second, the magnet must be non-toxic so that it does it harm the cow's health. Third, the magnet must be able to withstand the corrosive environment of the cow's stomach for many years, as it likely will never be removed. Fourth, the magnet must be dimensioned such that it is not likely to pass from the cow's stomach to the intestines. Fifth, the magnet should be designed so as to be easily introduced through a cow's throat and into its stomach. Sixth, the magnet should be inexpensive to construct, so as to allow its widespread use as a preventative measure. Seventh, the magnet should be configured such that the metal fragments will gather in a manner that poses the least risk of damage to the cow's stomach.

While many devices have attempted to adequately account for these factors, none have successfully done so. The need exists, therefor, for a durable yet non-toxic cow magnet possessing a relatively strong magnetic field that may be easily introduced into the stomach but that cannot pass into a cow's intestines, which safely collects metal fragments while being inexpensive to construct.

SUMMARY OF THE INVENTION

According to the present invention, a durable but non-toxic cow magnet having strong magnetic properties is provided. The magnet in accordance with the present invention may be configured to localize metal fragments at particular locations on its surface, so as to minimize the risk of injuring the cow's stomach. The magnet in accordance with the invention includes a cylindrical plastic cover with semi-spherical ends so as to allow it to be easily introduced into a cow's stomach. The cow magnet is dimensioned so as to not pass on to a cow's intestines. Further, a magnet in accordance with the invention may be efficiently and inexpensively manufactured.

BRIEF DESCRIPTION OF THE DRAWINGS

The preferred exemplary embodiment of the present invention will hereinafter be described in conjunction with the appended drawings, where like designations denote like elements, and.

DETAILED DESCRIPTION OF A PREFERRED EXEMPLARY EMBODIMENT

In accordance with the present invention, a cow magnet is provided that overcomes the limitations of the current art. The preferred embodiment cow magnet has non-toxic but durable outer surface, and produces a strong magnetic field that localizes metal fragments on the magnet's surface so as to minimize the risk of injury to a cow's stomach. The preferred embodiment magnet has a cylindrical shape that allows it to be easily inserted through a cow's throat and into the stomach using conventional insertion guns, while it is dimensioned to prevent it from easily passing from the first stomach to the intestines. The magnet may be economically manufactured, allowing its widespread preventative use.

Figure 1:
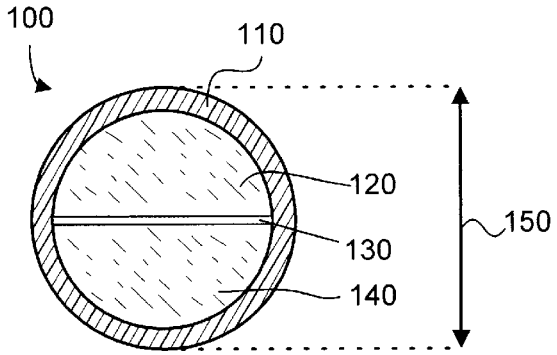
FIG. 1 is a cross section view of the preferred embodiment of a cow magnet in accordance with the invention.
Figure 2:
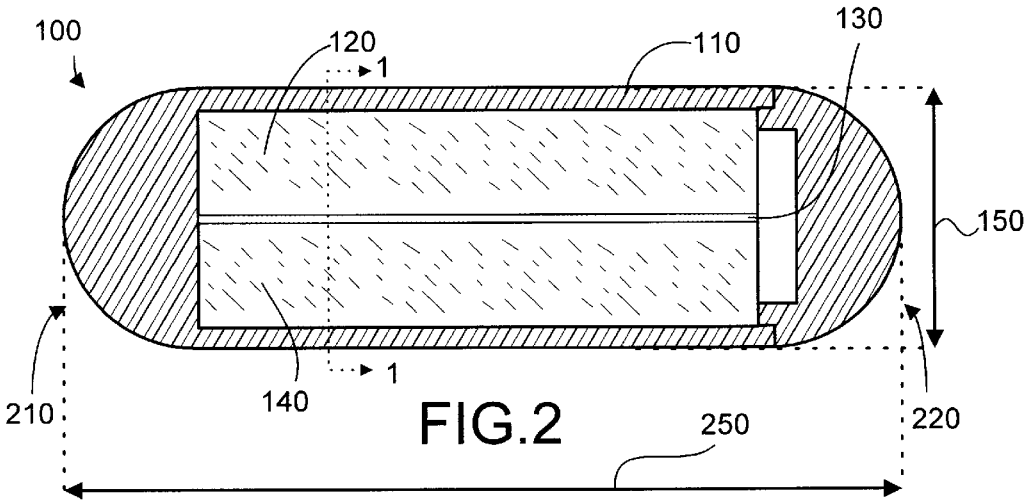
FIG. 2 is a cross section side view of the cow magnet shown in FIG. 1.

Referring now to FIGS. 1–2, a cow magnet 100 in accordance with the preferred embodiment is shown. FIG. 1 is a cross-section taken along line 1—1 of FIG. 2. The cow magnet 100 comprises a plastic case 110, a first magnet 120, a second magnet 140, and a metal plate 130.

In the preferred embodiment, the first magnet 120 and the second magnet 130 comprise ceramic magnets having a semi-cylindrical shape, and more particularly each comprises one-half of a right circular cylinder which has been divided by a plane passing through its axis of symmetry. The semi-cylindrical shapes each have a substantially flat, rectangular side between which the metal plate will be placed. Of course, other magnetic materials and shapes could be used.

The metal plate 130 is placed between the first semi-cylindrical magnet 120 and the second semi-cylindrical magnet 140. The metal plate 130 serves several functions. First, the metal plate 130 concentrates the magnetic field of the first magnet 120 and the second magnet 140, which enhances the attractive power of the cow magnet 100. Additionally, the metal plate tends to localize the magnetic field strength of the cow magnet 100 along is axial length. This is preferable because foreign matter held at the side of the magnet is less likely to injure the cow's stomach than matter held at the ends of the ends. For example, a nail localized to run parallel with the side of the magnet 100 is less likely to injure than one localized at the end. It should be noted that while the metal plate 130 is the preferred embodiment, other conductive materials could be used to form a conductive plate for the same purpose. The magnets 120, 140 and metal plate 130 are selected such that a nail of approximately two to three inches in length will attach to the cow magnet 10 with about one and a half ounces of force. This is sufficient force to retain a nail or other metal fragment securely, while still allowing it to slide along the surface of the cow magnet 100 should it contact the stomach lining. Thus, a nail or other metal fragment attached to the cow magnet 100 that contacts a cow's stomach lining will slide along the cow magnet 100 rather than puncturing the stomach lining.

The use of the two semi-cylindrical magnets and the metal plate between them has an additional advantage of being relatively easy to manufacture and correspondingly less expense than other, more complex designs.

The plate 130 and both magnets 120, 140 are enclosed in a plastic case 110. The plastic case 110 is preferably constructed of a durable, non-toxic plastic that will survive for many years in a cows stomach. The plastic case 110 may comprise a single piece formed around the magnets 120, 140 and the metal plate 130, or the case 110 may be formed of multiple pieces that are joined in a suitable manner, such as screwing, sonic welding, or compression joints. The plastic case 110 can be formed using any appropriate process, such as molding, etc.

Figure 3:
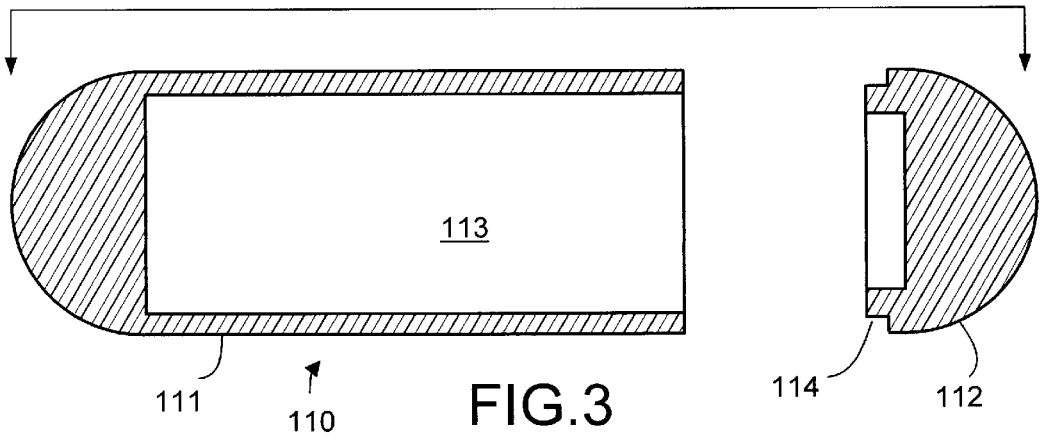
FIG. 3 is a side view of a plastic case in accordance with the preferred embodiment.

In the preferred embodiment, the plastic case 110 is formed in two pieces. Turning now to FIG. 3, a cross section of the preferred embodiment plastic ease 110 is illustrated. In this embodiment, the plastic case 110 includes a body portion 111 and a cap 112. The body portion is formed as a single piece with a semi-spherical end and a cylindrical hollow interior 113 in which the magnets and metal plates can be placed. The cap 112 includes the other semi-spherical end and a rim 114 to allow it to partially slide into the interior 113 and be coupled tightly in place. The cap 112 can then be glued or welded to the body portion 111 to assure adhesion.

Returning now to FIG. 2, the plastic case 110 is formed such that when the cow magnet 100 is assembled it has a first end 210 and a second end 220, both of which are semi-spherical. The first end 210 and the second end 220 are semi-spherical to allow the magnet 100 to be easily introduced through a cow's throat and into its stomach. The diameter 150 of the magnet is preferably about eleven - sixteenths of an inch, which allows the easy insertion of the magnet, but for the most part prevents the cow magnet 100 from passing from a cow's stomach and on to the intestines. The total length 250 of the cow magnet 100 is preferably about three inches, which is chosen to provide adequate surface area on which metal fragments may adhere while still being compact enough not to pose a problem during insertion or interfere with the function of a cow's stomach. The diameter 150 and length 250 of the assembled cow magnet are substantially the same in all embodiments disclosed herein.

In the preferred embodiment, the metal plate 130, the first semi-cylindrical magnet 120, and the second semi-cylindrical magnet 140 all extend along the length 250 of the cow magnet 100, but do not intrude the semi-spherical ends. This increases the relative strength of the magnetic field along the axial length of the cow magnet 100, while decreasing the relative magnetic strength at the ends. Again this configuration tends to accumulate the metal fragments along the length 250 of the cow magnet 100, concentrating them on the case 110 roughly adjacent to the metal plate 130. Furthermore, this reduces the likelihood of metal fragments collecting at the ends of the cow magnet, where they would be particularly apt to protrude in a manner that may be harmful to a cow's stomach.

Figure 4:
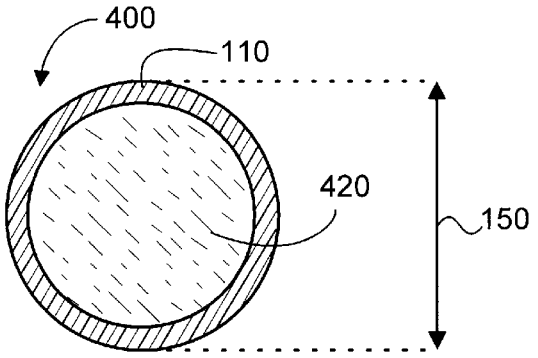
FIG. 4 is a cross section view of a second exemplary embodiment of a cow magnet in accordance with the invention.
Figure 5:
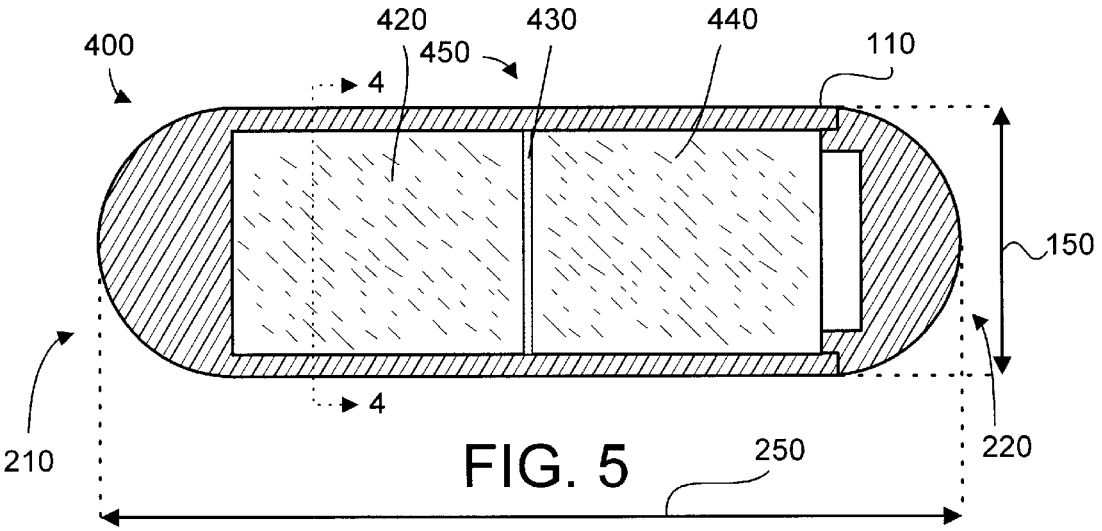
FIG. 5 is a cross section side view of the cow magnet shown in FIG. 4.

Referring now to FIGS. 4–5, a second embodiment of a cow magnet 400 in accordance with the invention is shown. FIG. 4 is a cross-section of FIG. 5 taken along line 4—4. This cow magnet 400 uses two cylindrical magnets 420, 440. The metal plate 430 is preferably a disk and is located between the two cylindrical magnets 420, 440. The first cylindrical magnet 420 is located proximate to the first end 210, while the second cylindrical magnet 440 is located proximate to the second end 220. The metal plate 430 is located approximately equidistant between the first end 210 and the second end 220, and extends across the diameter 150 of the magnet 400. This orientation of the metal plate 430 causes metal fragments to attach predominantly at the mid-section 450 of the magnet 400, roughly adjacent to the metal plate 430.

Figure 6:
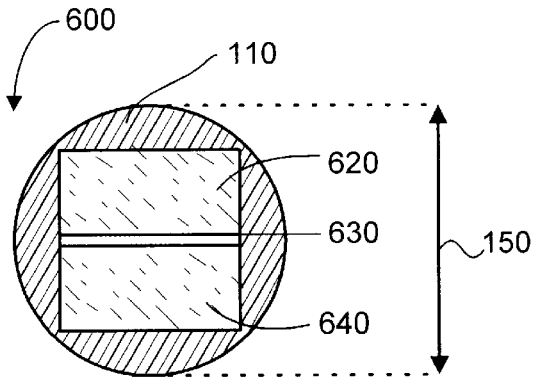
FIG. 6 is a cross section view of a third exemplary embodiment of a cow magnet in accordance with the invention.
Figure 7:
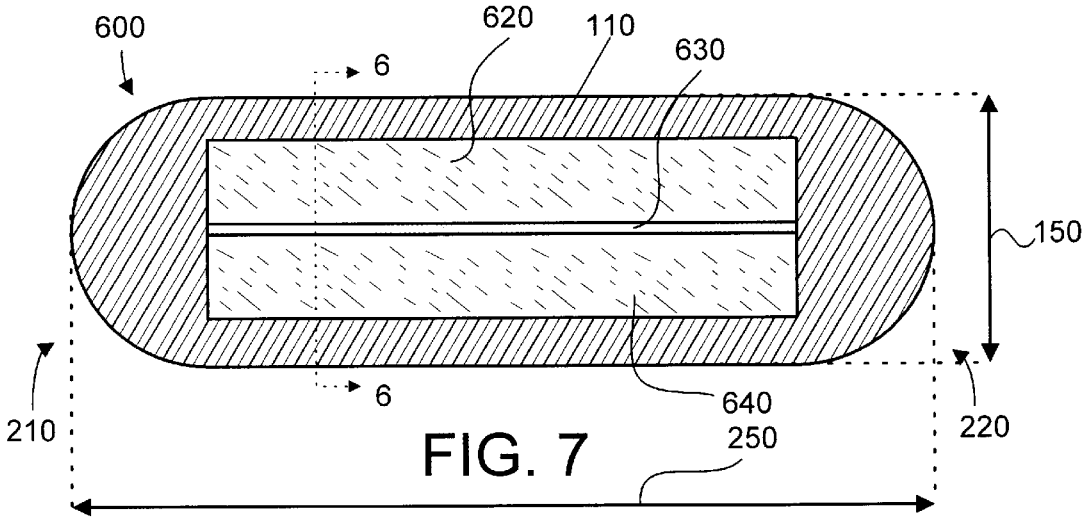
FIG. 7 is a cross section side view of the cow magnet shown in FIG. 6.

Referring now to FIGS. 6–7, a third embodiment of the cow magnet 600 is shown. FIG. 6 is a cross-section of FIG. 7 taken along line 6—6. This embodiment uses two rectangular magnets 620, 640. The metal plate 630 is located between the magnets 630, 640. The first rectangular magnet 620, the second rectangular magnet 640, and the metal plate 630 extend along the length 250 of the cow magnet 600 from the first end 210 to the second end 220. This results in metal fragments collecting predominantly along the length 250 of the cow magnet 600. The use of rectangular magnets 630, 640 is particularly advantageous from a financial point of view, as rectangular magnets tend to be less expensive than the disk shaped or annular magnets typically used in the art.

Figure 8:
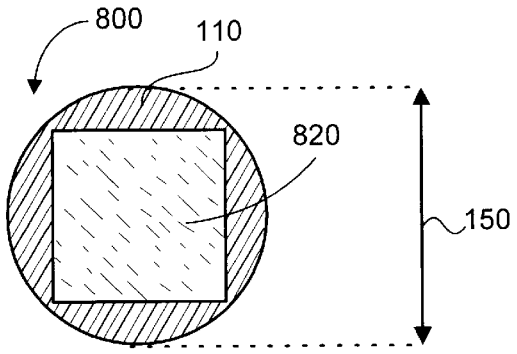
FIG. 8 is a cross section view of a fourth exemplary embodiment of a cow magnet in accordance with the invention.
Figure 9:
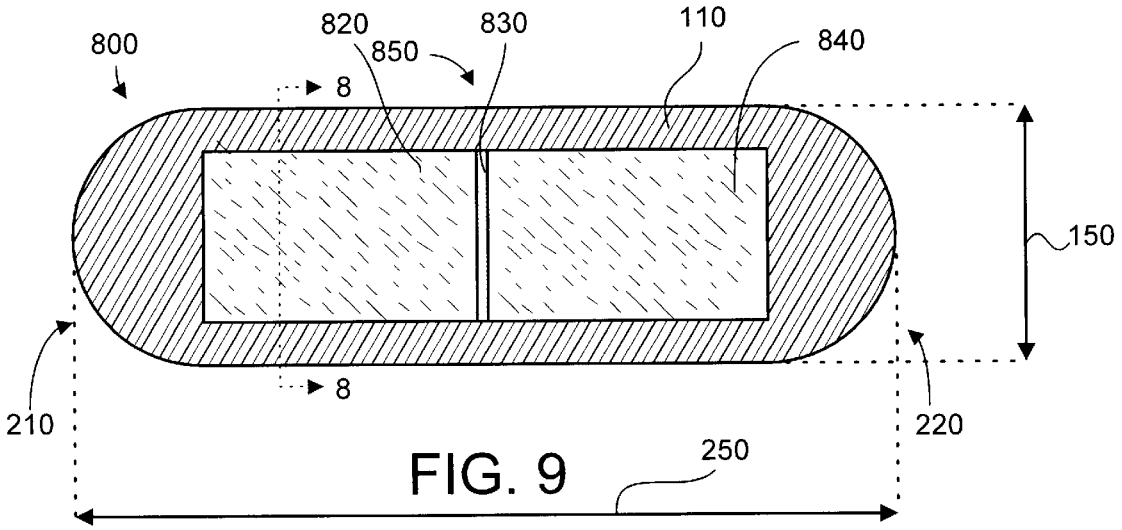
FIG. 9 is a cross section side view of the cow magnet shown in FIG. 8

Referring now to FIGS. 8–9, a fourth embodiment of a cow magnet 800 is shown. FIG. 8 is a cross-section of FIG. 9 taken along line 8—8. The first rectangular magnet 820 is located proximate to the first end 210, while the second rectangular magnet 840 is located proximate to the second end 220. The metal plate 830 is located substantially equidistant between the first end 210 and the second end 220, and extends across the cow magnet 800. The metal plate 830 may typically be expected to be rectangular in this embodiment. The cow magnet 800 will predominantly collect metal fragments at its mid-section 850, roughly adjacent to he metal plate 830.

Figure 10:
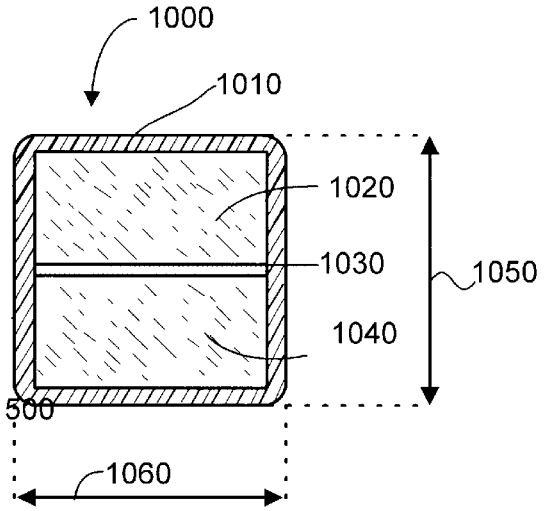
FIG. 10 is a cross section view of a fifth exemplary embodiment of a cow magnet in accordance with the invention.
Figure 11:
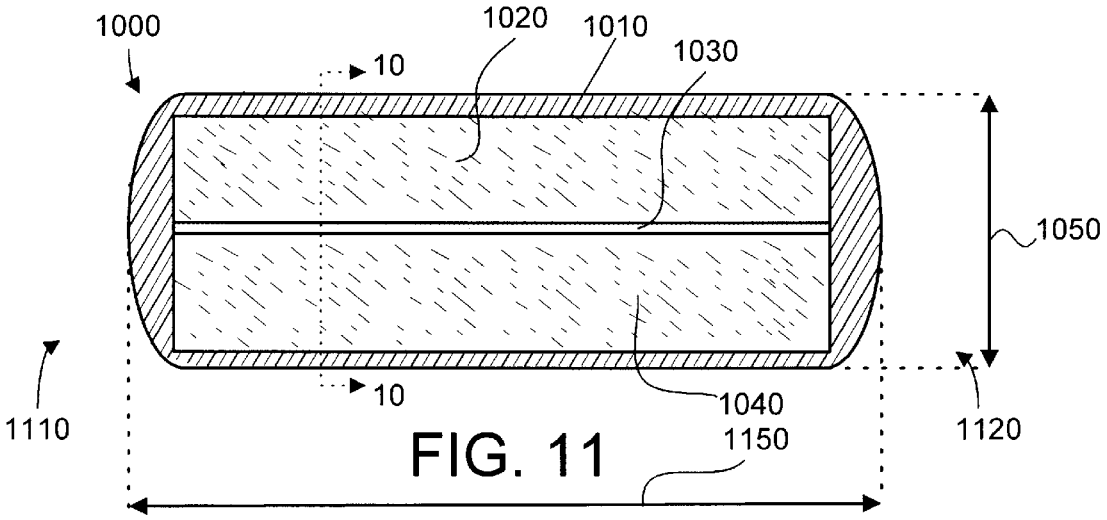
FIG. 11 is a cross section side view of the cow magnet shown in FIG. 10.

Referring now to FIGS. 10–11, a fifth embodiment of a cow magnet 1000 is shown. FIG. 10 is a cross-section of FIG. 11 taken along line 10—10. This embodiment differs from the other embodiments disclosed herein in that the exterior of the cow magnet 1000 is substantially a rectangular parallelepiped. The cow magnet 1000 thus has a rectangular cross section, as opposed to circular for the other illustrated embodiments. The cover 1010 is still preferably constructed of durable non-toxic plastic. Inside of the cover 1010 is a first magnet 1020 and a second magnet 1040. Both the first magnet 1020 and the second magnet 1040 are rectangular in shape. A metal plate 1030 is placed between the first magnet 1020 and the second magnet 1040. The cow magnet 1000 has first and 1110 and a second end 1120, both of which are slightly rounded. As shown in FIGS. 10–11, the first magnet 1020, the second magnet 1040, and the metal plate 1030 extend from the first end 1110 to the second end 1120, so that nails or other elongated metal fragments will attach along the length 1150 of the cow magnet 1000. The cow magnet 1000 has a length 1150 of approximately three inches, a width 1060 of approximately eleven-sixteenths of an inch, and a height 1050 of approximately eleven-sixteenths of an inch.

While the invention has been described in five embodiments, it is to be understood that the words which have been used are words of description rather than limitation, and that changes may be made within the purview of the appended claims without departing from the true scope and spirit of the invention in its broader aspects. For example, the cross-section of the cow magnet was shown as being circular, but may be of any shape. Each embodiment was shown as containing two magnets having identical sizes and shapes, but magnets of differing sizes and shapes may be combined with a metal plate without departing from the spirit of the invention. Materials other than plastics may be used to form the case. The dimensions may be varied as appropriate to user needs and manufacturing specifications. The degree to which the ends of the magnet are rounded may be varied. While the use of ceramic magnets was disclosed, the actual types of magnets used is not particularly important to the practice of the invention, so long as they create a sufficiently strong magnetic field to serve the user's purposes. Likewise, the metal plate may take many shapes and need not be metal, so long as its electromagnetic properties serve to concentrate the magnetic field at particular location on the surface of the magnet.

What is claimed is:

1. A cow magnet comprising:

a) a plastic cover, the plastic cover including:
a hollow interior;
an exterior;
a first end; and
a second end;

b) a first magnet contained within the hollow interior of the cover, the first magnet comprising a semi-cylindrical magnet extending from the first end of the cover to the second end of the cover;

c) a second magnet contained within the hollow interior of the cover, the second magnet comprising a semi-cylindrical magnet extending from the first end of the cover to the second end of the cover; and d) a conducting plate located within the hollow interior of the cover and positioned between the first magnet and the second magnet, the conducting plate extending from the first end of the cover to the second end of the cover.

2. A cow magnet comprising:

a) a plastic cover having a cylindrical exterior, a substantially semi-spherical first end, a substantially semi-spherical second end, and a hollow cylindrical interior having an axis extending from the first end to the second end;

b) a first magnet contained within the cylindrical interior of the cover; the first magnet comprising one-half of a circular cylinder having curved surface conforming to the cylindrical interior and a substantially flat surface extending along the axis of the cylindrical interior;

c) a second magnet contained within the cylindrical interior of the cover, the second magnet comprising one-half of a circular cylinder having curved surface conforming to the cylindrical interior and a substantially flat surface extending along the axis of the cylindrical interior; and d) a conductive plate contained within the hollow interior of the cover and disposed between the first magnet substantially flat surface and the second substantially flat surface.

3. The cow magnet of claim 2 wherein the first magnet and the second magnet comprise ceramic magnets.

4. The cow magnet of claim 2 wherein the conductive plate comprises a rectangular metal plate.

5. The cow magnet of claim 2 wherein the plastic cover comprises a body and a cap, the body having an open end and the cap a rim sized to couple with the open end of the body.

6. The cow magnet of claim 2 wherein the body has a length of approximately 3 inches.

7. The cow magnet of claim 2 wherein the body has a cylindrical diameter of approximately one inch.

8. A cow magnet consisting of:

a) a plastic cover comprising a body and a cap, the body having a cylindrical exterior, a semi-spherical first end an open second end and a hollow cylindrical interior having an axis extending from the first end to the second end, the cap having a semi-spherical exterior and rim sized to couple with the second opening of the body;

b) a first ceramic magnet contained within the hollow interior of the cover; the first ceramic magnet comprising one-half of a circular cylinder having curved surface conforming to the cylindrical interior and a substantially flat surface extending along the axis of the cylindrical interior;

c) a second ceramic magnet contained within the hollow interior of the cover; the second ceramic magnet comprising one-half of a circular cylinder having curved surface conforming to the cylindrical interior and a substantially flat surface extending along the axis of the cylindrical interior; and d) a metal plate contained within the hollow interior of the cover and disposed between the first ceramic magnet substantially flat surface and the second ceramic magnet substantially flat surface.

9. A cow magnet comprising:

a) a plastic cover having a rectangular exterior, a first end, a second end, and a hollow rectangular interior having an axis extending from the first end to the second end;

b) a first rectangular magnet contained within the rectangular interior of the cover; the first magnet having a first side extending along the axis of the rectangular interior;

c) a second rectangular magnet contained within the rectangular interior of the cover, the second magnet having a first side extending along the axis of the rectangular interior; and d) a conductive plate contained within the hollow interior of the cover and disposed between the first magnet first side and the and the second magnet first side.

10. The cow magnet of claim 9 wherein the first magnet and the second magnet comprise ceramic magnets.

11. The cow magnet of claim 9 wherein the conductive plate comprises a rectangular metal plate.

* * * * *